US005669195A

United States Patent [19]

Looverie et al.

[11] Patent Number: 5,669,195

[45] Date of Patent: Sep. 23, 1997

[54] WIRE BEAD PLASTER, STUCCO AND THE LIKE

[75] Inventors: Aloïs Looverie, Moen; Pol Timperman, Zwevegem, both of Belgium

[73] Assignee: N.V. Bekaert S.A., Zwevegem, Belgium

[21] Appl. No.: 523,432

[22] Filed: Sep. 5, 1995

[30] Foreign Application Priority Data

Oct. 4, 1994 [BE] Belgium ..... 9400898

[51] Int. Cl.[6] ..... E04B 1/00

[52] U.S. Cl. ..... 52/255; 52/342; 52/344

[58] Field of Search ..... 52/342–344, 255

[56] References Cited

U.S. PATENT DOCUMENTS

| | | | |
|---|---|---|---|
| 1,025,424 | 5/1912 | Priddle | 52/255 |
| 1,049,733 | 1/1913 | Knapp | 52/255 |
| 2,643,423 | 6/1953 | Brendel | 52/255 |
| 2,687,558 | 8/1954 | Dunlap | 52/255 |
| 3,175,330 | 3/1965 | Holsman | 50/165 |
| 4,472,919 | 9/1984 | Nourse | 52/344 X |

FOREIGN PATENT DOCUMENTS

| | | |
|---|---|---|
| 736065 | 11/1932 | France . |
| 19264007 | 1/1971 | Germany . |
| 12209 | of 1909 | United Kingdom . |

*Primary Examiner*—Carl D. Friedman
*Assistant Examiner*—Beth A. Aubrey
*Attorney, Agent, or Firm*—Shlesinger, Arkwright & Garvey LLP

[57] ABSTRACT

The invention relates to a wire bead (1) for plaster, stucco and the like comprising a strip of bent diagonal wires (2) and longitudinal wires (3) welded to one another, in which the strip is bent at an angle around a longitudinal wire (4) to form a wire bead (1) having a virtually V-shaped cross-section, in which the longitudinal wire running along the apex of the wire bead (1) is provided with a longitudinal profile (7) having a virtually triangular-shaped cross-section.

15 Claims, 1 Drawing Sheet

WIRE BEAD PLASTER, STUCCO AND THE LIKE

The invention relates to a wire bead for plaster, stucco and the like comprising a strip of bent diagonal wires and longitudinal wires welded to one another, in which the strip is bent at an angle around a longitudinal wire to form a wire bead having a virtually V-shaped cross-section.

Such wire beads of galvanized steel wire are generally known and are sold by the applicant, N. V. Bekaert S.A., under the trademark WIDRA®. Such a wire bead is described in U.S. Pat. No. 3,175,330, as well as in other sources.

Such wire beads are used in particular as plaster or stucco profile edging in plastering or stuccoing wall surfaces, in particular at the corners of building components. These wire beads exhibit many advantages, such as in particular the very open network structure due to which the steel wires, which are welded to one another, are very well embedded in the plaster, stucco or other cementitious material of the covering layer.

One disadvantage of the wire beads or plaster/stucco profile edging known in the prior art is that the longitudinal wire running along the apex of the wire bead easily becomes exposed or that the cementitious material, which usually is sprayed on, easily comes loose from the longitudinal apex wire of the wire bead, and as a result the longitudinal apex wire easily gives rise to rust formation.

From U.S. Pat. No. 3,175,330, mentioned above, a method is already known for providing the longitudinal apex wire with a plastic nose piece or sleeve overlying the length of this wire. To be sure, this solves the problem of rust formation around the longitudinal apex wire, but the problem of the plaster, stucco or other cementitious material coming loose is now observed to be even greater.

The applicant suspects that the loosening of the plaster, stucco, or other cementitious material is due to the fact that the granules or grains of the cementitious material glide easily over the curved or rounded surface of the apex longitudinal wire or the plastic nose piece that is overlying it.

It is an object of the invention to provide a wire bead of the type mentioned in the opening lines in which the problem of the cementitious material coming loose along the longitudinal apex wire of the wire bead is largely eliminated.

To this end, the invention proposes that the longitudinal wire lying along the apex of the wire bead should be provided with a longitudinal profile having a virtually triangular-shaped cross-section.

It has now been determined that with a wire bead according to the invention the problem of the cementitious material coming loose has been almost completely eliminated.

The invention will be explained in the following description on the basis of the accompanying drawing. In the drawing.

Figure 1:
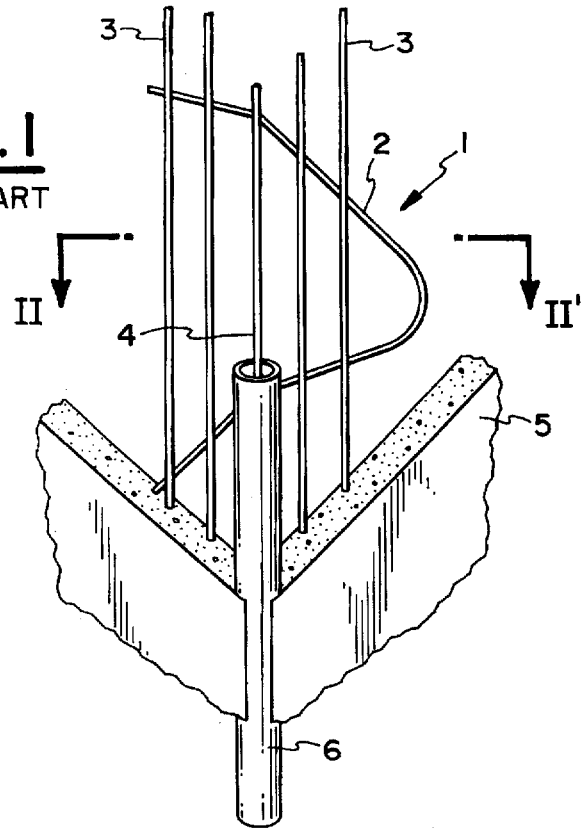
FIG. 1 PRIOR ART
FIG. 1 shows in perspective a portion of the wire bead with a plastic nose piece according to the prior art overlying the longitudinal apex wire.

FIG. 1 shows in perspective a wire bead 1 according to the prior art. The wire bead 1 comprises bent diagonal wires 2 and longitudinal wires 3 welded to one another. The diagonal wires 2 are preferably bent in a sinusoidal shape. The longitudinal wires 3 are by preference almost completely straight. The diagonal wires 2 and longitudinal wires 3 welded to one another form a wire strip with a very open network structure. The wire bead 1 is bent at an angle around a longitudinal wire 4 to form a wire bead having a virtually V-shaped cross-section.

Such wire beads 1 are generally known and are utilized in particular as plaster or stucco profile edging for the plastering or stuccoing of walls, such as for plastering or stuccoing of wall surfaces 5 at the corners of building components. The applicant, N. V. BEKAERT S.A., sells such wire beads or plaster profile edging under the trademark WIDRA®.

One drawback of the wire beads 1 according to the prior art is that the longitudinal apex wire 4 easily becomes exposed, because of which this wire 4 more readily gives rise to rust formation and all the detrimental consequences of this phenomenon. A procedure is already known for manufacturing such a wire bead 1 from galvanized steel wires in an effort to solve the problem of rust formation. This solution is nevertheless not effective enough for the longitudinal apex wire 4, which is located closest to the external surface of the plastered or stuccoed wall 5. For this reason, a method is already known—from the previously cited U.S. Pat. No. 3,175,330—for providing a plastic nose piece 6 to overlie the longitudinal apex wire 4 (see FIG. 1).

Figure 2:
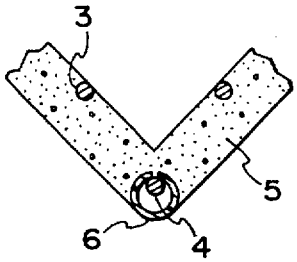
FIG. 2 PRIOR ART
FIG. 2 shows a cross-section along line II—II' in FIG. 1 according to the prior art.

FIG. 2 shows very clearly in cross-section the plastic nose piece 6 according to the prior art, overlying the longitudinal wire 4. The applicant has now determined that, to be sure, the problem of rust formation has by this means been solved, but that the problem of the plaster, stucco or other cementitious material coming loose in the vicinity of the longitudinal apex wire 4 has become even greater.

Figure 3:
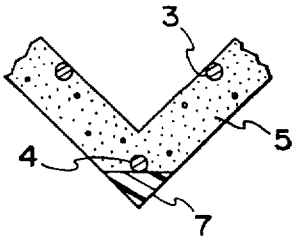
FIG. 3 shows a cross-section analogous to FIG. 2, but now of a first embodiment of a wire bead according to the invention.

FIG. 3 shows in cross-section a first embodiment of a wire bead 1 according to the invention. The longitudinal apex wire 4 is provided with a longitudinal profile 7 having a virtually triangular-shaped cross-section. The longitudinal profile 7 is by preference composed of plastic and is fixed with glue to the longitudinal wire 4 over its entire length.

Figure 4:
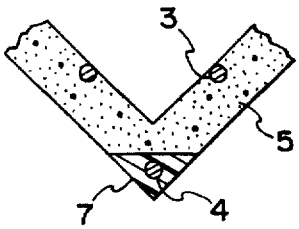
FIGS. 4–8 show cross-sections analogous to FIGS. 2 and 3, but of other embodiments of a wire bead according to the invention.

FIG. 4 shows in cross-section a second embodiment of a wire bead 1 according to the invention. Here the longitudinal apex wire 4 is completely embedded in the longitudinal profile 7. Here, too, the longitudial profile is by preference made of plastic.

Figure 5:
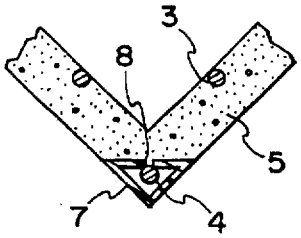

FIG. 5 shows in cross-section a third embodiment of a wire bead 1 according to the invention. Here the longitudinal apex wire 4 is provided with a plastic nose piece or hollow profile 7 having a virtually triangular-shaped cross-section, which overlies the longitudinal wire 4. To this end, the nose piece 7 is provided with a longitudinal slit 8.

Figure 6:
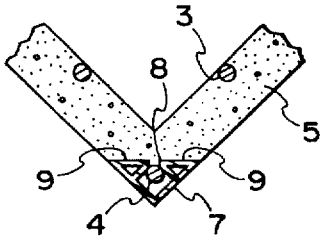

FIG. 6 shows in cross-section a fourth embodiment of a wire bead 1 according to the invention. Here the longitudinal apex wire 4 is provided with a plastic nose piece 7 having a longitudinal slit 8 and two raised longitudinal lips 9.

Figure 7:
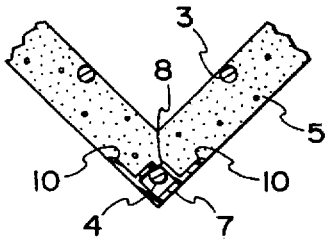

FIG. 7 shows in cross-section a fifth embodiment of a wire bead 1 according to the invention. Here the longitudinal apex wire 4 is provided with a plastic nose piece 7 having a longitudinal slit 8 and two longitudinal grooves 10.

Figure 8:
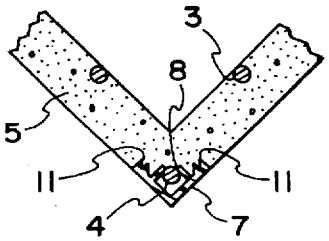

FIG. 8 shows a further embodiment of a wire bead 1 according to the invention. The two longitudinal grooves 10 are further provided with notches 11.

It has now been established that the coming loose of the plaster material along the longitudinal apex wire 4 in a wire bead 1 according to the invention is almost entirely eliminated. The anchoring of the plaster, stucco or other cementitious material on the apex 4 of a wire bead 1 according to the invention is probably due to the fact that the grains or granules of the cementitious material adhere better behind the longitudinal profile 7 of triangular-shaped cross-section. This is the case in particular in the embodiments according to FIGS. 7 and 8, in which the longitudinal grooves 10 ensure a strong anchoring of the cementitious material.

We claim:

1. A wire bead for plaster or stucco, comprising:

a) a strip of diagonal wires and longitudinal wires defining a substantially V-shaped cross-section;

b) one of said longitudinal wires being provided at the apex of said substantially V-shaped cross-section and being a longitudinal apex wire; and c) a longitudinal profile having a substantially triangular cross-section being disposed adjacent to said longitudinal apex wire.

2. The wire bead as defined in claim 1, wherein:

a) said longitudinal apex wire is embedded in said longitudinal profile.

3. The wire bead as defined in claim 1, wherein:

a) said longitudinal profile is disposed directly adjacent to said longitudinal apex wire.

4. The wire bead as defined in claim 1, wherein:

a) said longitudinal profile includes least one longitudinal groove.

5. The wire bead as defined in claim 1, wherein:

a) said longitudinal profile includes a hollow profile having a longitudinal slit; and b) said hollow profile overlies said longitudinal apex wire.

6. The wire bead as defined in claim 5, wherein:

a) said hollow profile includes two raised longitudinal lips configured for snapping over said apex wire.

7. The wire bead as defined in claim 5, wherein:

a) said hollow profile includes two longitudinal grooves.

8. The wire bead as defined in claim 7, wherein:

a) said hollow profile includes at least one longitudinal lip.

9. The wire bead as defined in claim 7, wherein:

a) said hollow profile includes at least one longitudinal groove.

10. The wire bead as defined in claim 1, wherein:

a) said longitudinal profile includes a hollow profile, and said hollow profile has a triangular cross-section.

11. A wire bead for plaster or stucco comprising:

a) a strip of diagonal wires and longitudinal wires defining a substantially V-shaped cross-section;

b) one of said longitudinal wires being provided at the apex of said substantially V-shaped cross-section and being a longitudinal apex wire;

c) a longitudinal profile having a substantially triangular cross-section being disposed adjacent to said longitudinal apex wire;

d) said longitudinal profile including a hollow profile having a longitudinal slit;

e) said hollow profile partially surrounding said longitudinal apex wire; and f) said hollow profile including at least one longitudinal groove.

12. The wire bead as defined in claim 11, wherein:

a) said hollow profile includes at least one notch.

13. The wire bead as defined in claim 11, wherein:

a) said hollow profile has a triangular cross-section.

14. The wire bead as defined in claim 11, wherein:

a) said at least one longitudinal groove extends outwardly relative to said longitudinal apex wire.

15. The wire bead as defined in claim 11, wherein:

a) said at least one longitudinal groove extends from an external face of said hollow profile.

* * * * *